US006186833B1

(12) United States Patent
Wu

(10) Patent No.: US 6,186,833 B1
(45) Date of Patent: Feb. 13, 2001

(54) HYBRID CONNECTOR WITH AUDIO JACK

(75) Inventor: Kun-Tsan Wu, Tu-Chen (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/454,677

(22) Filed: Dec. 3, 1999

(30) Foreign Application Priority Data

Oct. 21, 1999 (TW) ..... 88217916

(51) Int. Cl.[7] ..... H01R 24/04
(52) U.S. Cl. ..... 439/668; 439/80; 439/876
(58) Field of Search ..... 439/668, 80, 580, 439/669, 876, 79, 924.1

(56) References Cited

U.S. PATENT DOCUMENTS 5,022,872 * 6/1991 Shichida ..... 439/668
5,624,269 * 4/1997 Kanamori ..... 439/876

* cited by examiner

*Primary Examiner*—Khiem Nguyen
*Assistant Examiner*—Hae Moon Hyeon
(74) *Attorney, Agent, or Firm*—Wei Te Chung

(57) ABSTRACT

A hybrid connector with an audio jack comprises an elongate dielectric housing defining a number of grooves for receiving a number of terminals and a mating hole for accommodating a contact assembly. The contact assembly includes a first contact and a second contact for electrical connection with a complementary connector. The contact assembly further includes a third contact having a base, a pair of resilient engaging fingers depending forwardly from lateral edges of the base, a securing leg extending forwardly from a lower edge of the base and embedded in the housing for securing the third contact in the housing, and a soldering arm bending rearwardly from a top edge of the base for surface mounting the connector on a circuit board.

8 Claims, 7 Drawing Sheets

HYBRID CONNECTOR WITH AUDIO JACK

BACKGROUND OF THE INVENTION

1. Field of the Invention

The present invention relates to a hybrid connector with an audio jack, and particularly to a hybrid connector with an audio jack which has a terminal for making reliable mechanical and electrical connection to a circuit board at a middle level of the contact.

BRIEF DESCRIPTION OF THE PRIOR ART

Japanese application No. 6-36255 discloses a prior art contact 8 (shown in FIG. 7). The contact 8 includes a base 81, a pair of engaging fingers 82 forwardly extending from lateral edges of the base 81, a head 83 forwardly extending and defining a hole (not labeled) for latching the contact 8 with a housing (not shown) which receives the contact 8, a pair of securing legs 84 depending forwardly from the base 81 and a tail 85 extending rearwardly from the base 81. The head 83 and the securing legs 84 cooperate to mechanically retain the contact 8 in position. The tail 85 is used for surface mounting the contact 8 to a circuit board (not shown). The head 83 latches to a detention of the housing (not shown) and fits within a depression in the housing (not shown), so the housing requires enough thickness to accommodate the detention and the depression. Furthermore, the tail 85 extends from a bottom edge of the base 81 thereby restricting the housing (not shown) to being mounted by its bottom surface. These requirements are counter to the trend toward low profile connectors.

Hence, an improved electrical connector is required to overcome the disadvantages of the prior arts.

BRIEF SUMMARY OF THE INVENTION

A first object of the present invention is to provide a contact which is adapted for surface mounting on a circuit board at a middle level thereof; and A second object of the present invention is to provide a contact which is adapted to reliably engage with a complementary connector.

To achieve the above objects, a hybrid connector with an audio jack comprises an elongate dielectric housing, a plurality of terminals and a contact assembly.

The housing includes a plurality of grooves for receiving the plurality of terminals, and a mating hole disposed between a lateral end of the housing and the plurality of grooves. The mating hole extends through the housing and accommodates the contact assembly.

The contact assembly includes a first contact, a second contact and a third contact. The first contact has a resilient engaging finger extending forwardly from a base thereof and a soldering arm extending rearwardly from the base. The second contact has an elongate base, a soldering arm extending rearwardly from the base and a resilient engaging finger depending rearwardly from a front end of the base. The soldering arm of the second contact is identical to that of the first contact. The third contact includes a base, a soldering arm bending rearwardly from a top edge of the base, a pair of resilient engaging fingers depending forwardly from lateral edges of the base and a securing leg forwardly depending from the base. The pair of engaging fingers of the third contact slightly protrudes inwardly for reliably coupling with a complementary plug.

In assembly, the first and second contacts fit against lateral insides of the mating hole and the third contact is inserted in a rear of the mating hole. The securing leg of the third contact interferentially fits into the housing and the soldering arm of the third contact is soldered on a circuit board whereby the third contact is mechanically and electrically retained in position. The soldering arm of the third contact is adapted to be mounted on a circuit board at a point above a bottom of the housing. The complementary plug is inserted through a front of the mating hole while the engaging fingers of the first contact, the second contact and the third contact resiliently cooperate to establish electrical connection with the inserted complementary plug.

Other objects, advantages and novel features of the invention will become more apparent from the following detailed description of the present embodiment when taken in conjunction with the accompanying drawings.

DETAILED DESCRIPTION OF THE INVENTION

Figure 1:
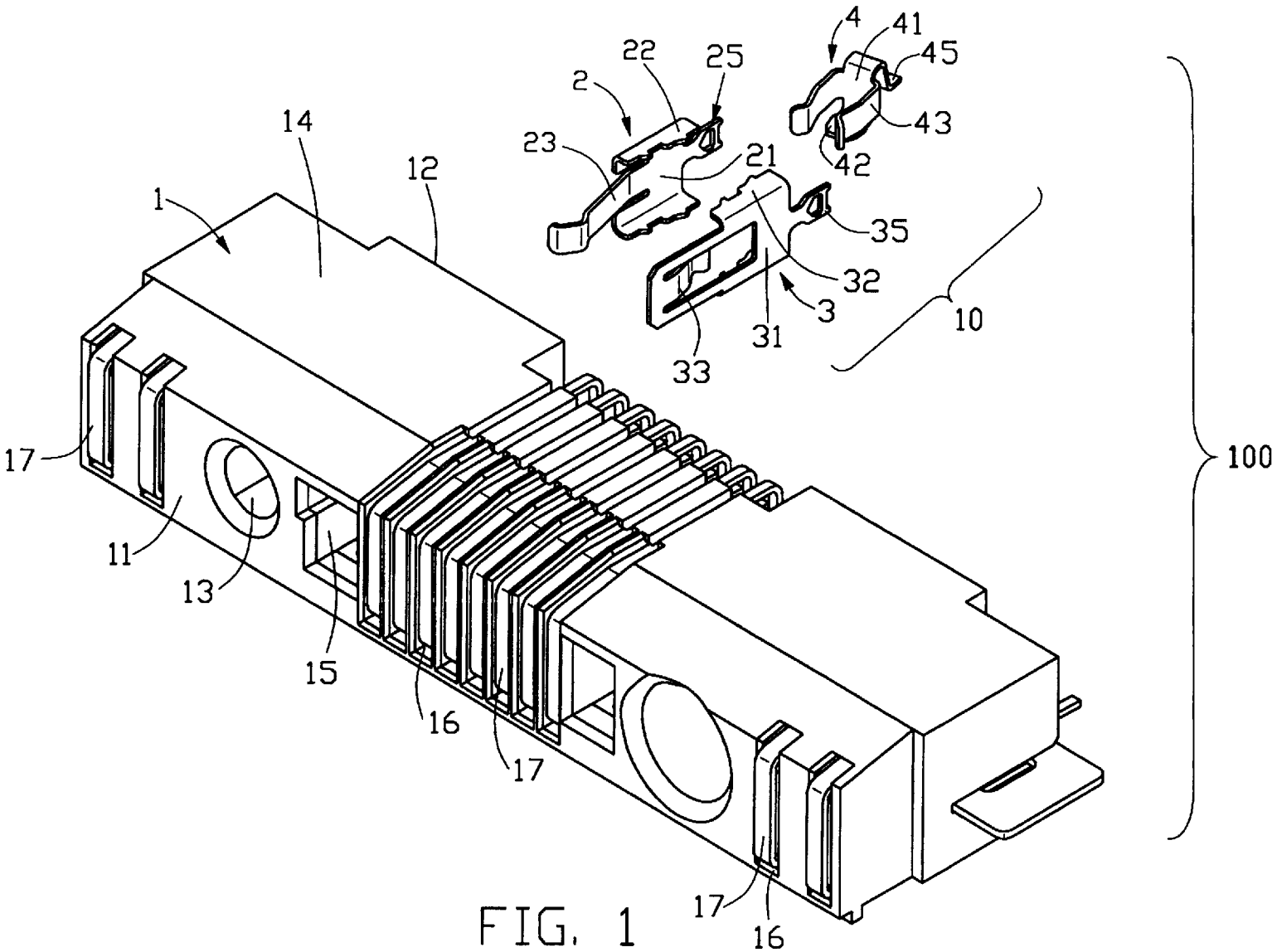
FIG. 1 is a partial assembled view of a hybrid connector with an audio jack of the present invention.

Referring to FIG. 1, a hybrid connector 100 with an audio jack of the present invention comprises an elongated insulating housing 1, a plurality of terminals 17 and a metallic contact assembly 10 accommodated in the housing 1.

The housing 1 defines a top surface 14, a front surface 11 and a rear surface 12 opposite the front surface 11. A plurality of grooves 16 for receiving the plurality of terminals 17 is located in middle and lateral ends of the housing 1 and extends along the front surface 11, the top surface 14 and the rear surface 12. A mating hole 13 is proximate to an end of the housing 1 and extends from the front surface 11 to the rear surface 12 for receiving the contact assembly 10 from a rear thereof and for receiving a mating connector plug (not shown) from a front thereof., A positioning opening 15 is interposed between the plurality of grooves 16 and the mating hole 13 for fixing a positioning post of a complementary connector (not shown).

Figure 4:
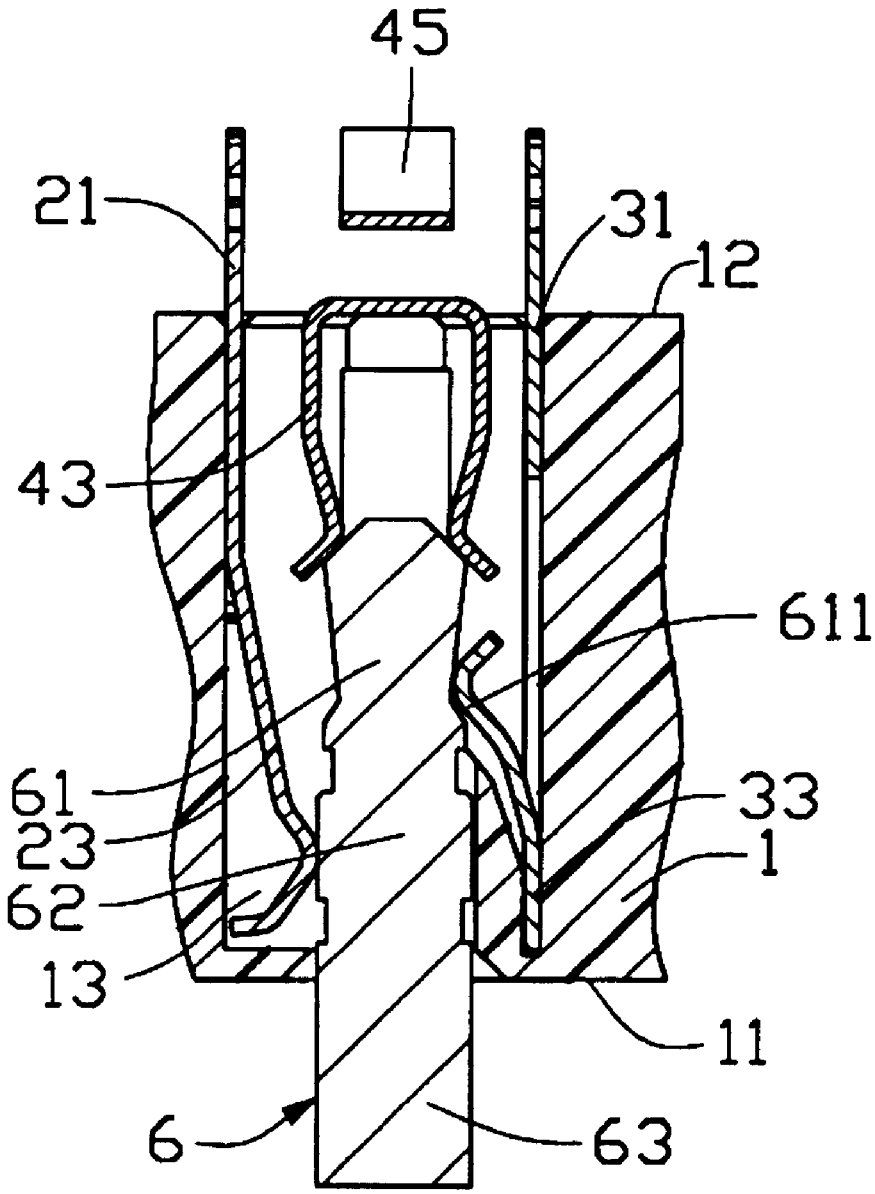
FIGS. 4 through 6 are serial fragmented sectional views of the contacts of FIG. 2 showing the insertion of a complementary plug.
Figure 5:
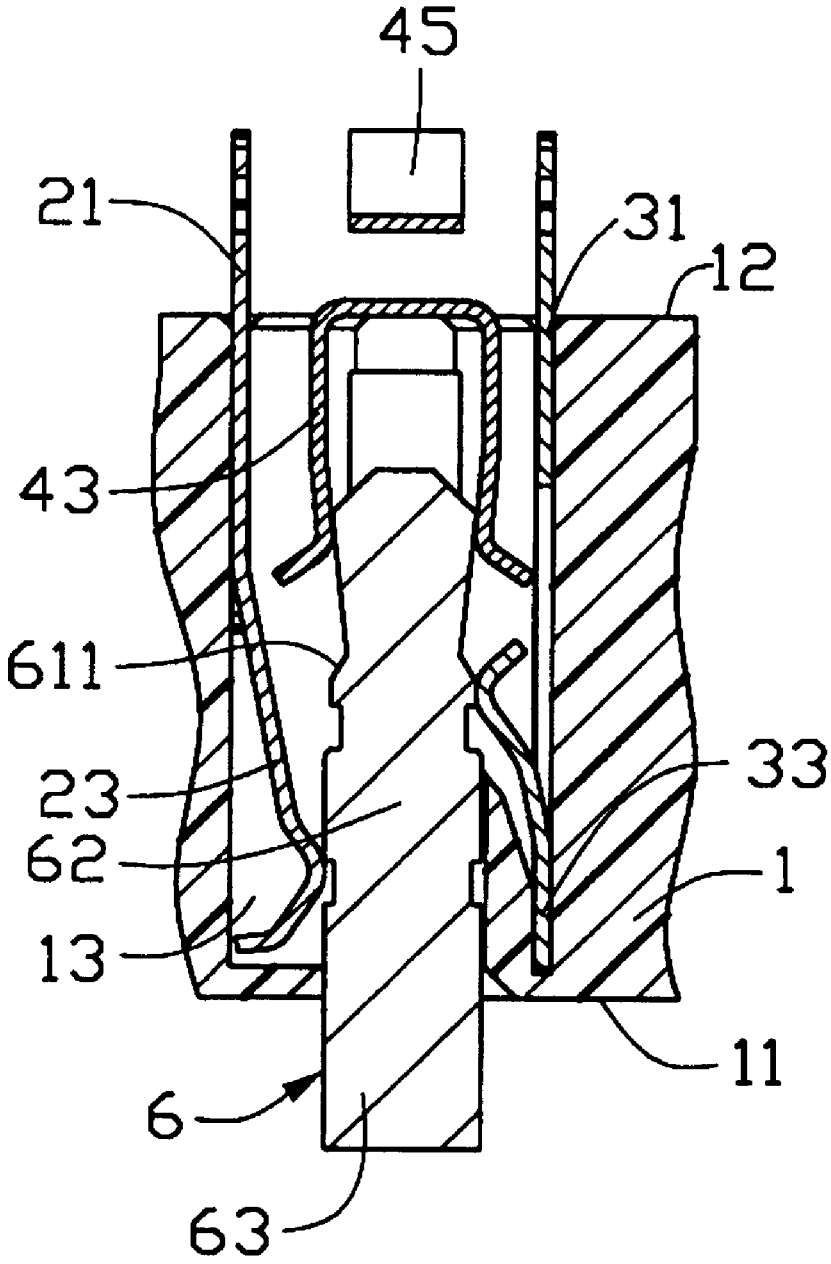
Figure 6:
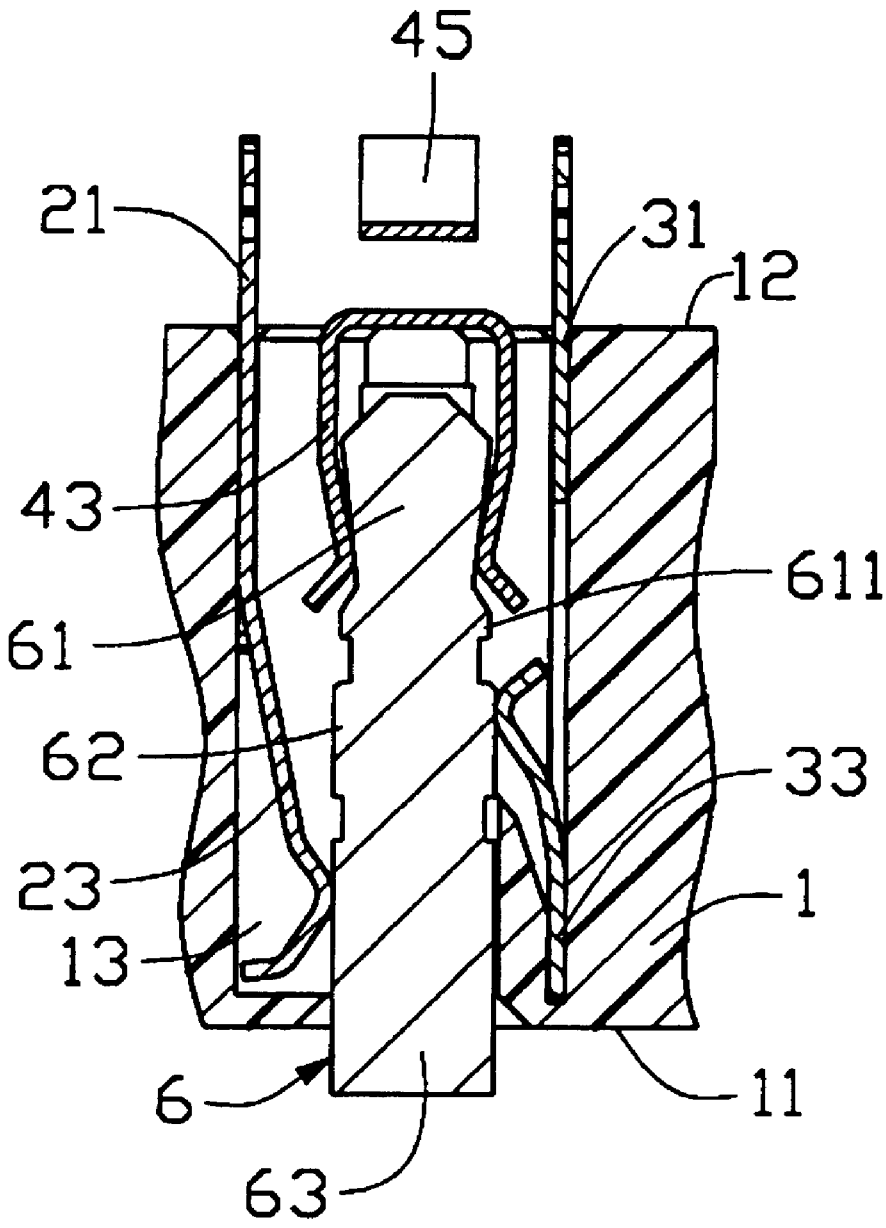
Figure 7:
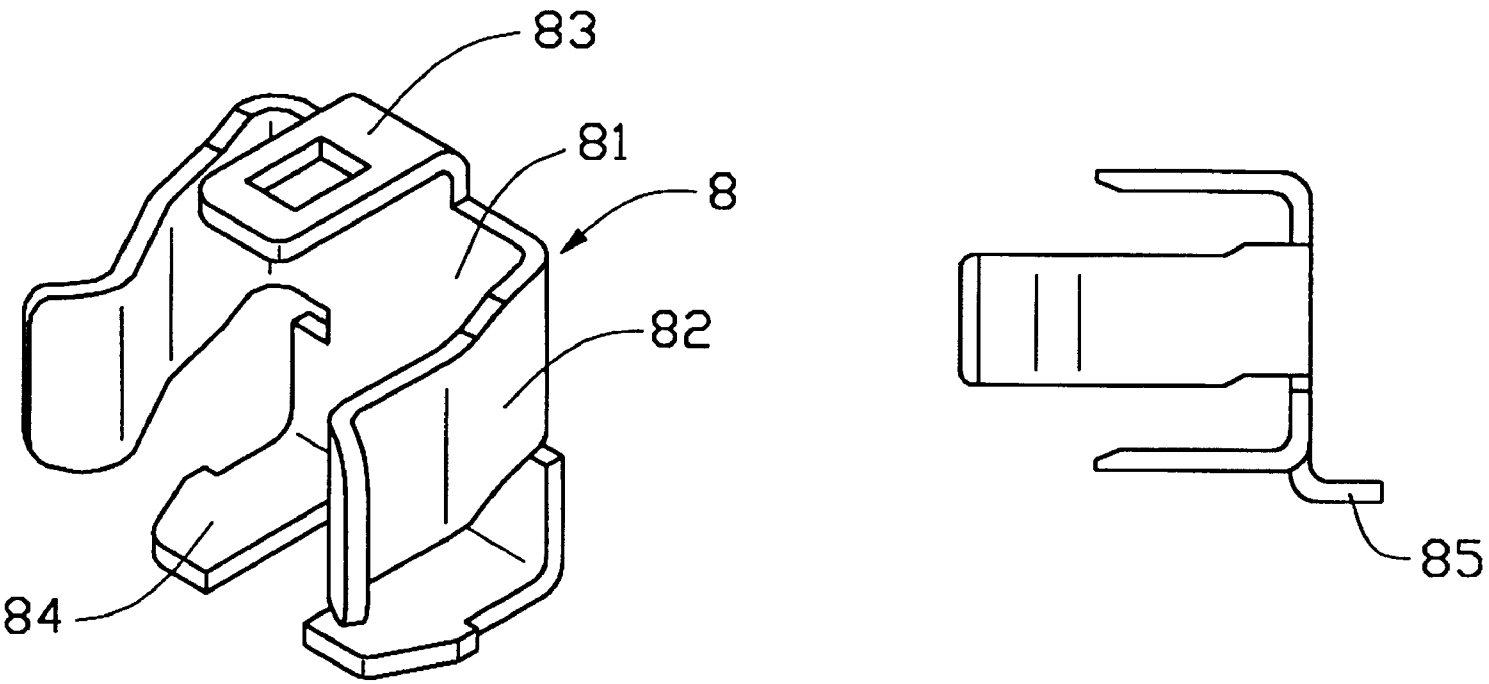
FIG. 7 (PRIOR ART)
FIG. 7 is a perspective view of a prior art contact.

The contact assembly 10 includes a first contact 2, a second contact 3 and a, third contact 4 for cooperatively engaging with a complementary plug 6 (see FIGS. 4 to 6).

The first contact 2 has a flat base 21, a pair of top and bottom securing wings 22 inwardly and horizontally depending from the base 21, an engaging finger 23 extending forwardly from the base 21, and a soldering arm 25 extending, rearwardly from the base 21. The resilient engaging finger 23 inwardly protrudes for mating with the plug 6 (see FIGS. 4 to 6).

The second contact 3 includes an elongated flat base 31, a pair of top and bottom securing wings 32 depending inwardly from the base 31, an engaging finger 33 depending rearwardly from the base 31, and a soldering arm 35; rearwardly extending from the base 31. The engaging finger 33 is stamped from the base 31 and inwardly protrudes for mating with the plug 6 (see FIGS. 4 to 6).

The third contact 4 includes a base 41, a soldering arm 45 bending rearwardly from a top edge of the base 41 for being welded on a circuit board 5 (see FIG. 3), a pair of resilient engaging fingers 43 depending forwardly from lateral edges of the base 41, and a securing leg 42 depending forwardly from a bottom of the base 41 for securing the third contact 4. The engaging fingers 43 slightly inwardly project for reliably contacting the plug 6 (see FIGS. 4 to 6). The soldering arm 45 is adapted for a soldered connection with the top surface of the circuit board 5, which is above a bottom of the housing 1 thereby reducing a height of the top surface 14 above the circuit board 5. The contact 4 is secured by the securing leg 42 embeddedly engaging with the housing 1 and the soldering arm 45 mounted on the circuit board 5.

Figure 2:
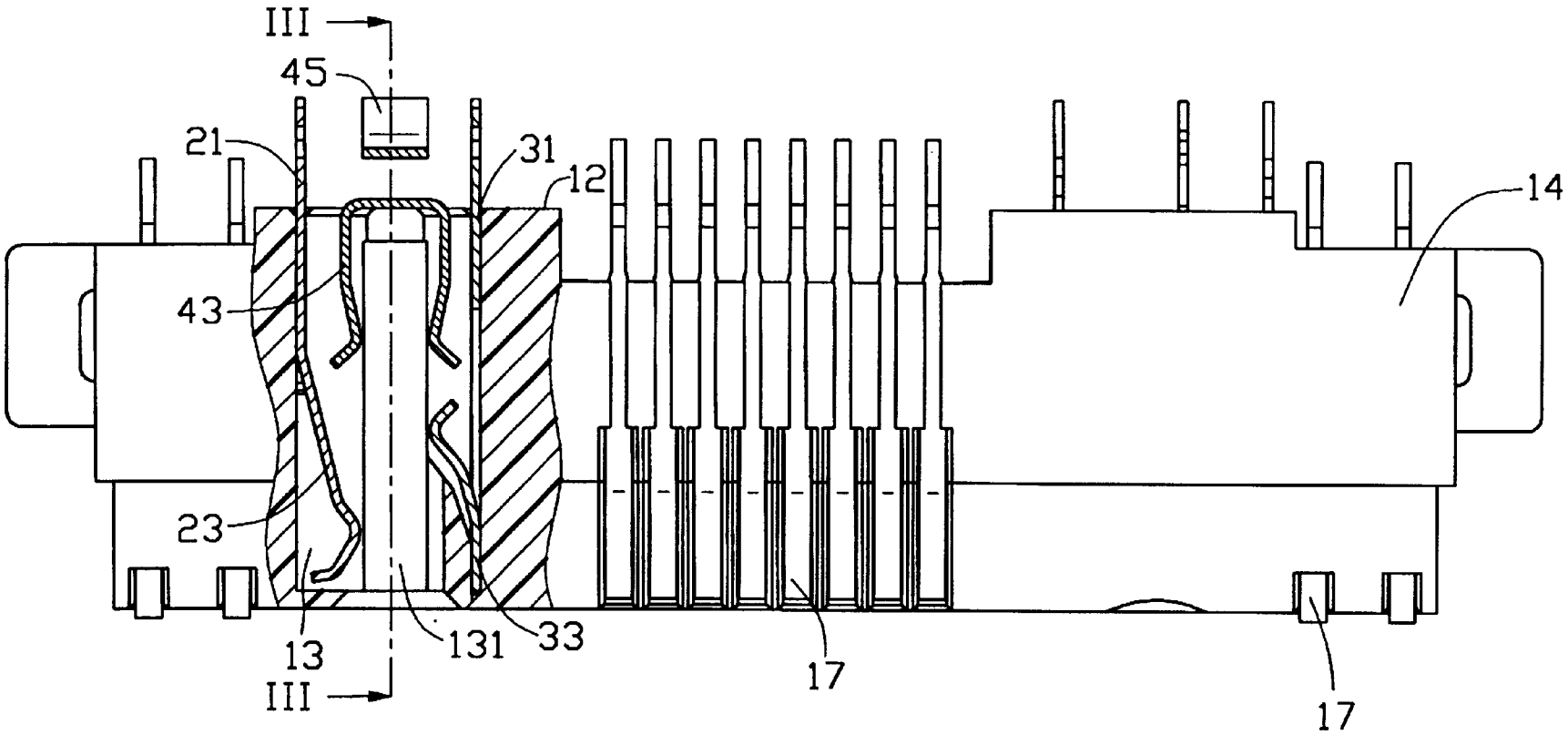
FIG. 2 is a top assembled view of the hybrid connector of FIG. 1 with a partial sectional view of the contacts of the audio jack of FIG. 1.
Figure 3:
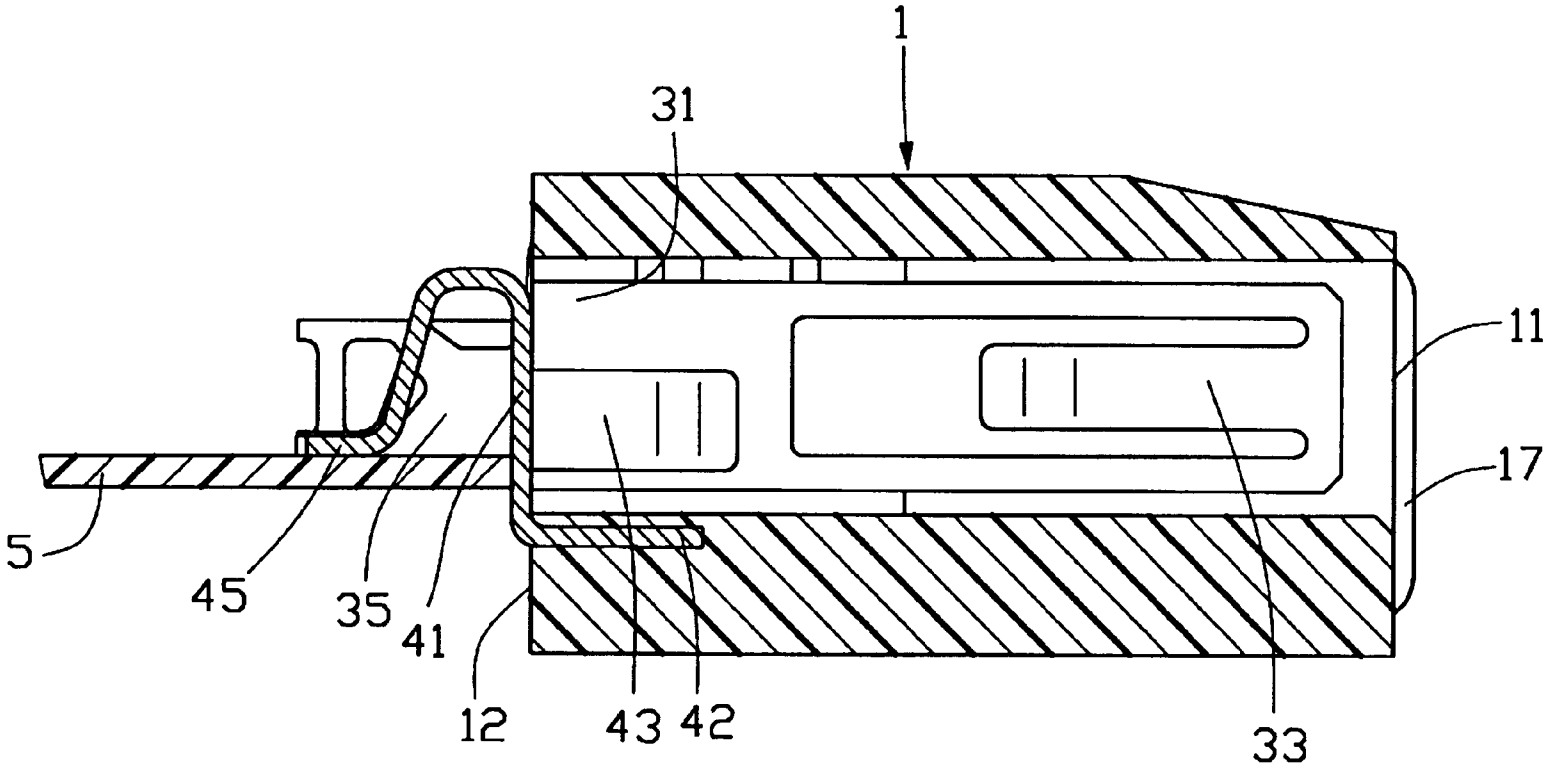
FIG. 3 is a side sectional view of the hybrid connector of FIG. 2 taken along the line III—III.

Further referring to FIGS. 2 and 3, in assembly, the first and second contacts 2 and 3 fit against lateral interior sides of the mating hole 13 of the housing 1 whereby the soldering arms 25 and 35 extend rearwardly out of the housing 1 for making a soldered connection with the circuit board 5. The third contact 4 is assembled from a rear of the mating hole 13 and interposes between the first and second contacts 2, 3 whereby the soldering arm 45 thereof extends rearwardly out of the housing 1. The securing leg 42 of the third contact 4 embeddedly engage with the housing 1 for retaining the contact 4. The engaging fingers 43 of the third contact 4 are separated by a recess 131 of the housing 1 for securely contacting the plug 6 therebetween. Soldering surfaces of the soldering arms 25, 35, 45 are at a level above the bottom of the housing 1 and are mounted on the circuit board 5. Referring to FIGS. 4 to 6, the complementary plug 6 is shown gradually being inserted into the mating hole 13 along the recess 131. The engaging finger 23 of the first contact 2 initially mates with a second portion 2 of the plug 6 and slides along the plug 6 to a third portion 63 as the plug 6 is inserted; while the engaging finger 33 of the second contact 3 initially mates with a first portion 61 of the plug 6 and slides along the plug 6 to the second portion 62. The engaging fingers 43 of the third contact 4 initially mate with a foremost end of the plug 6. As the plug 6 is further inserted, the engagement between the plug 6 and the engaging fingers 43 moves along an outer surface of the first portion 61 to a rearwardly facing surface 611. The symmetric, inwardly protruding engaging fingers 43 clamp the first section 61 from a rearward face, thereby generating a pull force to pull the first section 61 of the plug 6, thereby securely positioning the plug 6 and reliably contacting the plug 6.

It is to be understood, however, that even though numerous characteristics and advantages of the present invention have been set forth in the foregoing; description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. An electrical connector comprising:

a dielectric member; and a contact assembly received in the dielectric member and including:

a first contact and a second contact each having a base secured in the dielectric member, an engaging finger depending from the base for engaging with a mated plug head, and a soldering arm extending from the base; and a third contact having a base secured in the dielectric member, a pair of engaging fingers depending from the base, a securing portion depending from a bottom of the base and a soldering arm bent from a top of the base for surface mounting on a circuit board.

2. The electrical connector as claimed in claim 1, wherein the third contact is integrally formed from a sheet of metal.

3. The electrical connector as claimed in claim 1, wherein the engaging fingers of the third contact protrude toward each other for facilitating engagement with the mated plug head.

4. The electrical connector as claimed in claim 1, wherein the soldering arms of the contacts are at a level above a bottom of the dielectric member.

5. A contact comprising:

a base;

a pair of engaging fingers depending from lateral ends of the base for contacting an inserted connector;

a securing portion bending from a longitudinal end of the base for securing the contact in a connector; and a soldering arm depending from an opposite longitudinal end of the base for surface mounting the contact on a circuit board.

6. The electrical connector as claimed in claim 5, wherein the contact is integrally formed from a sheet of metal.

7. The electrical connector as claimed in claim 5, wherein the pair of engaging fingers protrudes toward each other for facilitating engagement with an inserted connector.

8. An electrical connector assembly comprising:

a dielectric member defining a mating hole therein; and a contact assembly received within the dielectric member, said contact assembly including:

a first contact and a second contact positioned on two opposite sides of the mating hole, the first contact and the second contact defining first and second engaging fingers extending forwardly and rearwardly, respectively;

a third contact disposed around a rear portion of the mating hole and mounted to said dielectric member, said third contact defining a pair of forwardly extending third engaging fingers and a soldering arm surface mounted on a circuit board above a bottom of said dielectric member where said third contact is mounted; and a mated plug head rearwardly extending into the mating hole and simultaneously contacting all the first, second and third engaging fingers.

* * * * *